US006830431B2

(12) United States Patent
Bariaud et al.

(10) Patent No.: US 6,830,431 B2
(45) Date of Patent: Dec. 14, 2004

(54) HIGH-TEMPERATURE BEHAVIOR OF THE TRAILING EDGE OF A HIGH PRESSURE TURBINE BLADE

(75) Inventors: Christian Bariaud, La Ville du Bois (FR); Jacques Boury, Saint-Ouen en Brie (FR)

(73) Assignee: SNECMA Moteurs, Paris (FR)

( * ) Notice: Subject to any disclaimer, the term of this patent is extended or adjusted under 35 U.S.C. 154(b) by 45 days.

(21) Appl. No.: 10/303,012

(22) Filed: Nov. 25, 2002

(65) Prior Publication Data

US 2003/0108425 A1 Jun. 12, 2003

(30) Foreign Application Priority Data

Dec. 10, 2001 (FR) ..... 01 15904

(51) Int. Cl.[7] ..... F01D 5/08
(52) U.S. Cl. ..... 416/97 R; 415/115
(58) Field of Search ..... 416/97 R; 415/115

(56) References Cited

U.S. PATENT DOCUMENTS 3,807,892 A 4/1974 Frei et al.
4,500,258 A * 2/1985 Dodd et al. ..... 416/97 R
4,601,638 A 7/1986 Hill et al.
5,403,158 A * 4/1995 Auxier ..... 416/97 R
5,857,837 A 1/1999 Zelesky et al.

FOREIGN PATENT DOCUMENTS

EP 1 128 024 8/2001

* cited by examiner

*Primary Examiner*—Edward K. Look
*Assistant Examiner*—Richard A. Edgar
(74) *Attorney, Agent, or Firm*—Oblon, Spivak, McClelland, Maier & Neustadt, P.C.

(57) ABSTRACT

A moving blade for a high pressure turbine of a turbomachine. The blade has at least one cooling circuit including at least one cavity extending radially between a tip and a root of the blade, at least one air admission opening at one of radial ends of the at least one cavity to feed the at least one cooling circuit with cooling air, and a plurality of slots opening out from the at least one cavity and into a side of the blade in a vicinity of the trailing edge of the blade. The slots are arranged along the trailing edge between the root and the tip of the blade substantially perpendicular to a longitudinal axis of the blade, at least the slot closest to the root of the blade presenting an inclination towards the tip of the blade lying in the range 10° to 30° relative to an axis of rotation of the blade.

15 Claims, 1 Drawing Sheet

HIGH-TEMPERATURE BEHAVIOR OF THE TRAILING EDGE OF A HIGH PRESSURE TURBINE BLADE

BACKGROUND OF THE INVENTION

1. Field of the Invention

The present invention relates to the field of moving blades for the high pressure turbine of a turbomachine, and more particularly it relates to slots for exhausting cooling air that are situated in the trailing edges of the moving blades of a high pressure turbine.

2. Discussion of the Invention

In conventional manner, a turbomachine has a combustion chamber in which air and fuel are mixed together prior to being burnt therein. The gas that results from this combustion flows downstream inside the combustion chamber and then feeds a high pressure turbine. The high pressure turbine has one or more rows of moving blades spaced apart circumferentially all around the rotor of the turbine. The moving blades of the high pressure turbine are thus subjected to the very high temperatures of the combustion gases. These temperatures reach values well above those which can be withstood without damage by the blades that come into contact with said gas, thereby shortening their lifetime.

In order to solve this problem, it is known to provide these blades with internal cooling circuits seeking to reduce the temperature thereof. By means of such circuits, cooling air, which is generally introduced into a blade via its root, flows along the blade following a path formed by cavities formed in the blade prior to being ejected through slots that open out through the surface of the blade. More precisely, these cooling exhaust slots are generally distributed along the trailing edge of the blade, between its root and its tip, in a manner that is substantially perpendicular to the longitudinal axis of the blade.

It is also known that the blades of a high pressure turbine fitted with cooling circuits are made by molding. The locations of the cooling circuit slots are conventionally reserved by cores placed parallel to one another in the mold prior to casting the metal. In order to make it easier to cast the metal, the cooling air exhaust slot closest to the root of the blade is generally made to have dimensions that are larger than the dimensions of the other slots.

Unfortunately, in practice, it is found that the slot closest to the root of the blade is poorly cooled. Because of the large dimensions of this slot and because of the centrifugal force generated by the blade rotating, air exhausted via this slot tends to be deflected towards the tip of the blade. As a result large temperature gradients arise in the vicinity of the trailing edge which lead to cracking in the vicinity of the slot that is particularly harmful to the lifetime of the blade. These large temperature gradients also tend to propagate by conduction towards the zone where the root of the blade is connected to the platform supporting the blade.

BRIEF SUMMARY OF THE INVENTION

The present invention thus seeks to mitigate such a drawback by proposing a moving blade for a high pressure turbine, the blade presenting a novel shape for the cooling air exhaust slot closest to the root of the blade, which slot does not lead to cracking. The invention also seeks to avoid degrading the general mechanical strength of the blade which is a part that is subjected to very high levels of mechanical stress. Finally, the invention seeks to provide a high pressure turbine for a turbomachine fitted with such moving blades.

To this end, the invention provides a moving blade for a high pressure turbine of a turbomachine, the blade having at least one cooling circuit comprising at least one cavity extending radially between a tip and a root of the blade, at least one air admission opening at one of the radial ends of the cavity(ies) to feed the cooling circuit(s) with cooling air, and a plurality of slots opening out from the cavity(ies) and into the trailing edge of the blade, the slots being arranged along the trailing edge between the root and the tip of the blade in a manner that is substantially perpendicular to a longitudinal axis of the blade, wherein at least the slot closest to the root of the blade presents an inclination towards the tip of the blade lying in the range 10° to 30° relative to an axis of rotation of the blade.

As a result, the cooling air exhausted through the slot closest to the root of the blade is guided over the entire surface of the slot so as to avoid cracking appearing therein. This particular shape for the slot makes it possible to reduce the local temperature around said slot by about 5%. In addition, the ability of the blade to withstand the various mechanical stresses to which it is subjected is not degraded by this shape of slot.

Advantageously, the inclination of the slot closest to the root of the blade is about 20°.

In order to lower the temperature of a connection zone between the root of the blade and a platform defining the flow stream of combustion gases through the high pressure turbine, the upstream end of the slot closest to the root of the blade is essentially formed in said connection zone.

BRIEF DESCRIPTION OF THE DRAWING

Other characteristics and advantages of the present invention appear from the following description made with reference to the accompanying drawing which shows an embodiment having no limiting character. In the figures.

DETAILED DESCRIPTION OF THE PREFERRED EMBODIMENTS

Figure 1:
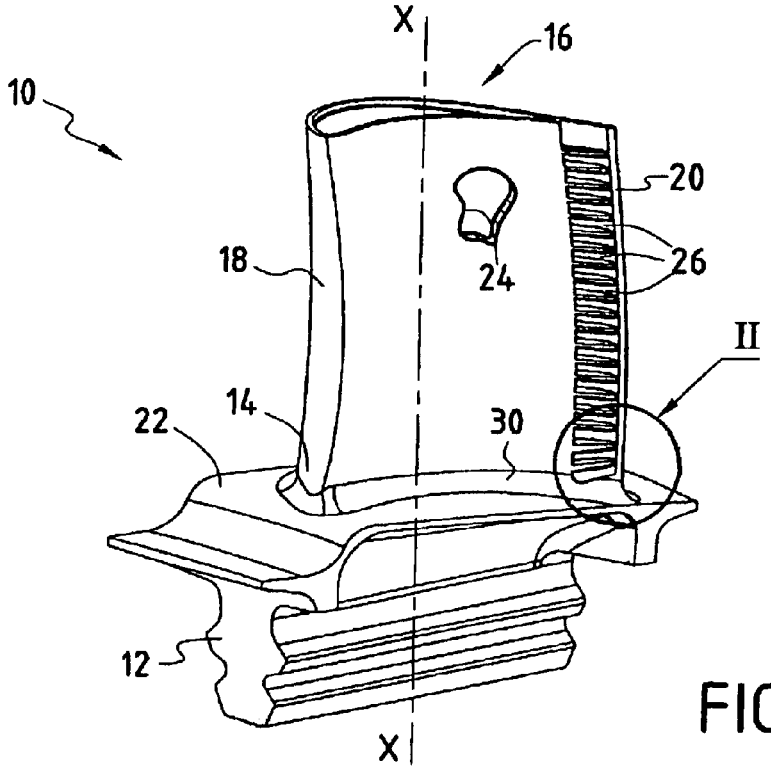
FIG. 1 is a perspective view of a moving blade for a high pressure turbine in accordance with the invention.

FIG. 1 is a perspective view of a moving blade 10, e.g. for a high pressure turbine of a turbomachine. This blade has a longitudinal axis X-X and it is fixed to a rotor disk (not shown) of the high pressure turbine via a generally firtree shaped shank 12. It typically comprises a root 14, a tip 16, a leading edge 18, and a trailing edge 20. The shank 12 is connected to the root 14 of the blade via a platform 22 which defines a wall for the flow stream of combustion gases through the high pressure turbine.

Such a blade is subjected to the very high temperatures of combustion gases and it needs to be cooled. For this purpose, and in conventional manner, the moving blade 10 has at least one internal cooling circuit. This cooling circuit is constituted, for example, by at least one cavity 24 extending radially between the root 14 and the tip 16 of the blade. This cavity is fed with cooling air from one of its radial ends via an air admission opening (not shown). This air admission opening is generally provided via the shank 12 of the blade. A plurality of slots 26 are also provided opening out from the cavity 24 into the trailing edge 20 of the blade so as to exhaust the cooling air flowing in the cavity. These cooling air exhaust slots 26 are typically distributed along the trailing edge 20 between the root 14 and the tip 16 of the blade, extending substantially perpendicularly to the longitudinal axis X-X of the blade.

Figure 2:
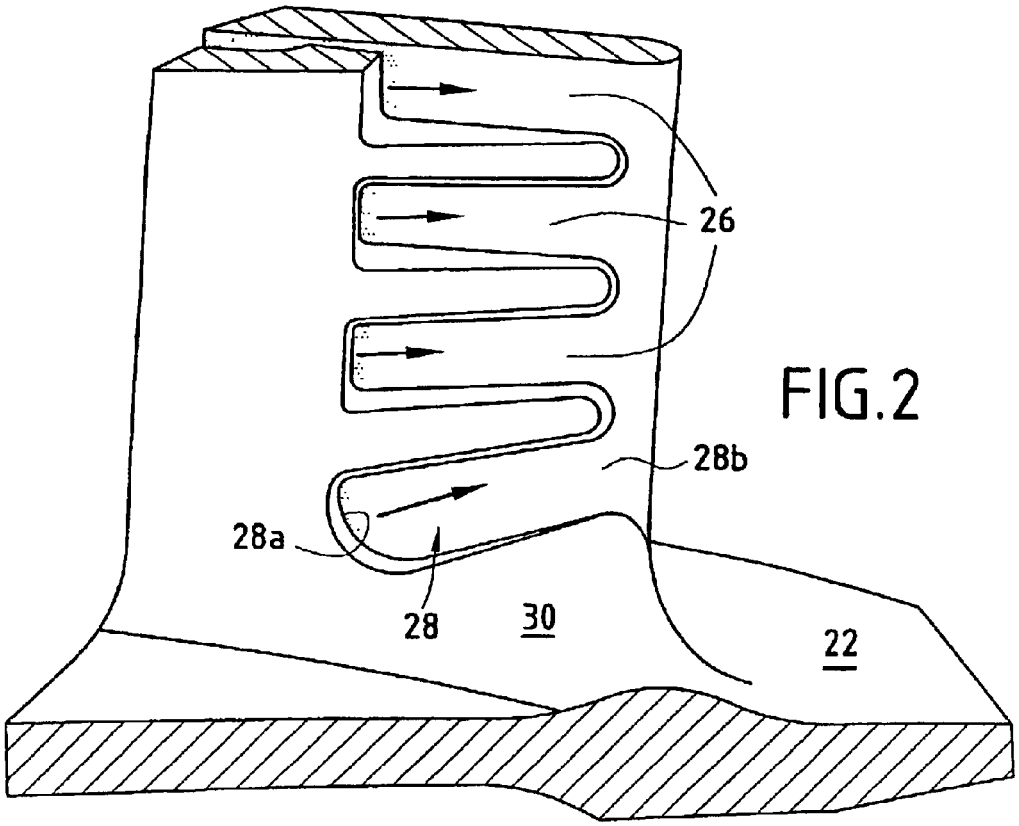
FIG. 2 is an enlarged view of a portion of FIG. 1 showing the cooling air exhaust slot closest to the root of the blade.

FIG. 2 shows more clearly the shape of the slot 28 closest to the root 14 of the blade 10. In accordance with the invention, the slot 28 closest to the root of the blade slopes towards the tip 16 of the blade at an angle lying in the range 10° to 30° relative to an axis of rotation of the blade (not shown). The angle of inclination of this slot is preferably about 20°. This particular angle of inclination for the slot 28 that is closest to the root of the blade makes it possible to make the temperature in the vicinity thereof more uniform, thereby eliminating any hot points. The cooling air exhausted via this slot covers the entire surface of the slot 28 and lowers local temperature by about 5%. Thus, any risk of cracking in the vicinity of the slot closest to the root of the blade disappears and the lifetime of the blade is lengthened.

According to an advantageous characteristic of the invention, the upstream end 28*a* of the slot 28 closest to the root 14 of the blade is essentially formed in a connection zone 30 between the root 14 of the blade and the platform 22 beside the flow stream of combustion gases such that the air exhausted through said slot tends to cool the connection zone 30 by thermal conduction. The temperature of the connection zone 30 between the root 14 of the blade and the platform 22 is thus cooled by about 1.5%. In order to increase the cooling of the connection zone 30, the sharp angles at the upstream end 28*a* of the slot 28 are milled so as to make it easier to guide the air exhausted through the slot towards said zone 30. Furthermore, since the downstream end 28*b* of the slot 28 closest to the root of the blades is not formed in the connection zone 30, the ability of the blade 10 to withstand various mechanical stresses is unaffected by this particular shape for the slot.

What is claimed is:

1. A moving blade for a high pressure turbine of a turbomachine, the moving blade comprising:

at least one cooling circuit comprising:

at least one cavity extending radially between a tip and a root of the blade, at least one air admission opening at one of radial ends of the at least one cavity to feed the at least one cooling circuit with cooling air, and a plurality of slots opening out from the at least one cavity and into a side of the blade in a vicinity of a trailing edge of the blade, the slots arranged between the root and the tip of the blade substantially perpendicular to a longitudinal axis of the blade, except for at least the slot closest to the root of the blade that presents an inclination towards the tip of the blade lying in a range 10° to 30° relative to an axis of rotation of the blade.

2. A blade according to claim 1, wherein the inclination of the slot closest to the root of the blade is about 20°.

3. A blade according to claim 1, wherein an upstream end of the slot closest to the root of the blade is formed essentially in a connection zone between the root of the blade and a platform defining a wall for a flow stream of combustion gas through the high pressure turbine.

4. A blade according to claim 3, wherein any sharp angles at the upstream end of the slot closest to the root of the blade are milled.

5. A high pressure turbine of a turbomachine, the turbine having a plurality of moving blades according to claim 1.

6. A moving blade for a high pressure turbine of a turbomachine, the moving blade comprising:

at least one cooling circuit comprising:

at least one cavity extending radially between a tip and a root of the blade, at least one air admission opening at one of radial ends of the at least one cavity to feed the at least one cooling circuit with cooling air, and a plurality of slots opening out from the at least one cavity and into a concave side of the blade in a vicinity of a trailing edge of the blade, the slots arranged between the root and the tip of the blade substantially perpendicular to a longitudinal axis of the blade, except for at least the slot closest to the root of the blade presents an inclination towards the tip of the blade lying in a range 100 to 300 relative to an axis of rotation of the blade.

7. A blade according to claim 6, wherein the inclination of the slot closest to the root of the blade is about 20°.

8. A blade according to claim 6, wherein an upstream end of the slot closest to the root of the blade is formed essentially in a connection zone between the root of the blade and a platform defining a wall for a flow stream of combustion gas through the high pressure turbine.

9. A blade according to claim 8, wherein any sharp angles at the upstream end of the slot closest to the root of the blade are milled.

10. A high pressure turbine of a turbomachine, the turbine having a plurality of moving blades according to claim 6.

11. A moving blade for a high pressure turbine of a turbomachine, the moving blade comprising:

at least one cooling circuit comprising:

at least one cavity extending radially between a tip and a root of the blade, at least one air admission opening at one of radial ends of the at least one cavity to feed the at least one cooling circuit with cooling air, and a plurality of slots opening out from the at least one cavity and into a side of the blade in a vicinity of a trailing edge of the blade, the slots arranged between the root and the tip of the blade substantially perpendicular to a longitudinal axis of the blade, except for only the slot closest to the root of the blade presents an inclination towards the tip of the blade lying in a range 10° to 30° relative to an axis of rotation of the blade.

12. A blade according to claim 11, wherein the inclination of the slot closest to the root of the blade is about 20°.

13. A blade according to claim 11, wherein an upstream end of the slot closest to the root of the blade is formed essentially in a connection zone between the root of the blade and a platform defining a wall for a flow stream of combustion gas through the high pressure turbine.

14. A blade according to claim 13, wherein any sharp angles at the upstream end of the slot closest to the root of the blade are milled.

15. A high pressure turbine of a turbomachine, the turbine having a plurality of moving blades according to claim 11.

* * * * *